US006542124B1

(12) United States Patent
Yoon

(10) Patent No.: US 6,542,124 B1
(45) Date of Patent: Apr. 1, 2003

(54) SURFACE MOUNTED CHIP ANTENNA

(75) Inventor: Jong Cheol Yoon, Kyungki-do (KR)

(73) Assignee: Samsung Electro-Mechanics Co., Ltd., Kyungki-do (KR)

( * ) Notice: Subject to any disclaimer, the term of this patent is extended or adjusted under 35 U.S.C. 154(b) by 0 days.

(21) Appl. No.: 10/034,381

(22) Filed: Jan. 3, 2002

(30) Foreign Application Priority Data

Sep. 12, 2001 (KR) ..... 01-56079

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 5,959,582 A * 9/1999 Kawahata et al. ... 343/700 MS
6,133,881 A 10/2000 Kushihi et al. ..... 343/700 MS
6,281,848 B1 * 8/2001 Nagumo et al. ..... 343/700 MS
6,300,909 B1 * 10/2001 Tsubaki et al. ..... 343/700 MS
6,323,811 B1 * 11/2001 Tsubaki et al. ..... 343/700 MS
6,384,786 B2 * 5/2002 Ito et al. ..... 343/700 MS
6,433,745 B1 * 8/2002 Nagumo et al. ..... 343/700 MS
6,452,548 B2 * 9/2002 Nagumo et al. ..... 343/700 MS

* cited by examiner

*Primary Examiner*—Tan Ho
(74) *Attorney, Agent, or Firm*—Lowe Hauptman Gilman & Berner, LLP

(57) ABSTRACT

Disclosed herein is a surface mounted chip antenna. The surface mounted chip antenna has a dielectric block, a ground electrode, a radiation electrode and a feeding pattern. The dielectric block is constructed in the form of a rectangular solid having first and second opposite major surfaces. The ground electrode is formed on the first major surface of the dielectric block. The radiation electrode resonates at a predetermined resonance frequency and has a radiation portion and a short portion. The feeding pattern is formed on at least one side surface of the dielectric block and is spaced apart from the radiation electrode and the ground electrode.

9 Claims, 3 Drawing Sheets

SURFACE MOUNTED CHIP ANTENNA

BACKGROUND OF THE INVENTION

1. Field of the Invention

The present invention relates generally to surface mounted chip antennas, and more particularly to a surface mounted chip antenna, for easily performing impedance matching by forming a protrusion on at least one side portion of a feeding pattern, and adjusting distances between a radiation electrode and the feeding pattern, and between the feeding pattern and a ground electrode using the protrusion.

2. Description of the Prior Art

Generally, surface mounted chip antennas are used as antennas for small-sized communication devices, and have been recently popularized as global positioning system (GPS) antennas within mobile communication terminals. Typically, in a surface mounted chip antenna, a feeding pattern, a radiation electrode, and a ground electrode are formed on a rectangular hexahedral dielectric. The surface mounted chip antenna performs an antenna function by receiving high frequency (RF) signals through the feeding pattern, and radiating part of the high frequency signals into space using the radiation electrode.

FIG. 1 is a view showing a conventional surface mounted chip antenna 10. Referring to FIG. 1, the surface mounted chip antenna 10 has a dielectric block 2 made of a ceramic body or a resin. The dielectric block 2 is provided with a ground electrode 3 formed on a first major surface 2*a* of the dielectric block 2, a radiation electrode 4 formed on a second major surface 2*b* of the dielectric block 2, and a feeding pattern 5 formed on a region of the dielectric block 2 ranging from part of the first major surface 2*a* to part of its adjacent side surface. The radiation electrode 4 is especially formed to be spaced apart from the feeding pattern 5, and connected to the ground electrode 3 through two short portions 7 and 8 formed on different side surfaces. Further, the radiation electrode 4 has a length of $\lambda/4$, where $\lambda$ is a wavelength of a resonance frequency.

In the surface mounted chip antenna 10, capacitance is formed between the feeding pattern 5 and the radiation electrode 4, and the radiation electrode 4 is excited by an inductance passing through the formed capacitance. In other words, the high frequency signal received by the feeding pattern 5 is transmitted to the radiation electrode 4 through the capacitance formed between the radiation electrode 4 and the feeding pattern 5. Then, the radiation electrode 4 resonates as a microstripline resonator, such that the part of electric field generated between the radiation electrode 4 and the ground electrode 5 is radiated into space. As described above, the surface mounted chip antenna 10 can be operated as a resonator antenna.

Further, as shown in FIG. 1, the two short portions 7 and 8 for connecting the radiation electrode 4 to the ground electrode 5 are formed on different side surfaces, and additionally serve to disperse a current density.

In such a surface mounted chip antenna 10, a resonance circuit is formed by the capacitance between the ground electrode 3 and the radiation electrode 4, and the inductance of the radiation electrode 4. In this case, the resonance frequency is adjusted by mutually coupling the radiation electrode 4 and the feeding pattern 5 using the capacitance between the radiation electrode 4 and the feeding pattern 5. However, the conventional surface mounted chip antenna 10 is disadvantageous in that it is difficult to adjust the resonance frequency because an electrode is previously formed on a surface through a designated patterning process so as to correspond to a predetermined resonance frequency.

Meanwhile, a ceramic body with a high dielectric constant (typically, a material having more than a dielectric constant of twenty) has been used as a material of the dielectric block to miniaturize the antenna. However, the ceramic body has a high specific gravity and a high material cost, such that it is undesirable to apply the ceramic body to antennas for mobile communication terminals. Further, the surface mounted chip antenna using the ceramic body with a high dielectric constant is disadvantageous in that it has a significantly narrow frequency bandwidth. Subsequently, as environment conditions of the antenna change, as when the mobile communication terminals are close to a human body, the operation frequency of the antenna is deviated from a usable frequency band, such that reception sensitivity of satellite signals rapidly decreases.

Therefore, in such antenna technological fields, there is required a new constructive surface mounted chip antenna for easily adjusting a resonance frequency and realizing miniaturization of the antenna even if the antenna uses a ceramic body with a low dielectric constant.

SUMMARY OF THE INVENTION

Accordingly, the present invention has been made keeping in mind the above problems occurring in the prior art, and an object of the present invention is to provide a surface mounted chip antenna, which has a protrusion on at least one side portion of its feeding pattern to easily perform impedance matching.

Another object of the present invention is to provide a surface mounted chip antenna, which has at least one conduction pattern on a side surface of a dielectric block to lower a resonance frequency or reduce antenna size.

In order to accomplish the above objects, the present invention provides a surface mounted chip antenna comprising a dielectric block constructed in the form of a rectangular solid having first and second opposite major surfaces; a ground electrode formed on the first major surface of the dielectric block; a radiation electrode for resonating at a predetermined resonance frequency, the radiation electrode comprising a radiation portion formed on the second major surface of the dielectric block and a short portion formed on at least one side surface of the dielectric block and used for coupling the radiation portion and the ground electrode; and a feeding pattern formed on at least one side surface of the dielectric block and spaced apart from the radiation electrode and the ground electrode, the feeding pattern having at least one protrusion on a portion adjacent to the radiation electrode.

According to a preferred embodiment of the present invention, the feeding pattern has a T shape, in which each protrusion is formed on both side portions of the feeding pattern, thus enabling an impedance matching to be easily performed. Further, if necessary, the protrusion of the feeding pattern can be formed to be extended to a side surface adjacent to the side surface on which the feeding pattern is formed.

Further, in another preferred embodiment of this invention, a through hole is formed for passing through opposite side surfaces of the dielectric block, and so the weight of the dielectric material is reduced. Further, the through hole can have a cylinder shape or a square pillar shape with a rectangular section.

Meanwhile, according to the present invention, the short portion of the radiation electrode, which is connected to the ground electrode, can be formed on any side surface not adjacent to the side surface on which the feeding pattern is formed.

Further, in another preferred embodiment of this invention, at least one conduction pattern is formed to be extended from the radiation electrode to some portion of a side surface of the dielectric block, or to be extended from the ground electrode to some portion of a side surface of the dielectric block, thus allowing the resonance frequency to be lowered by increasing capacitive coupling between the radiation electrode and the ground electrode, or the antenna to be further miniaturized in the case of same resonance frequency.

BRIEF DESCRIPTION OF THE DRAWINGS

The above and other objects, features and other advantages of the present invention will be more clearly understood from the following detailed description taken in conjunction with the accompanying drawings, in which:

FIG. 2*b* is a circuit diagram of an equivalent circuit of the chip antenna shown in FIG. 2*a.

DESCRIPTION OF THE PREFERRED EMBODIMENTS

Figure 2A:
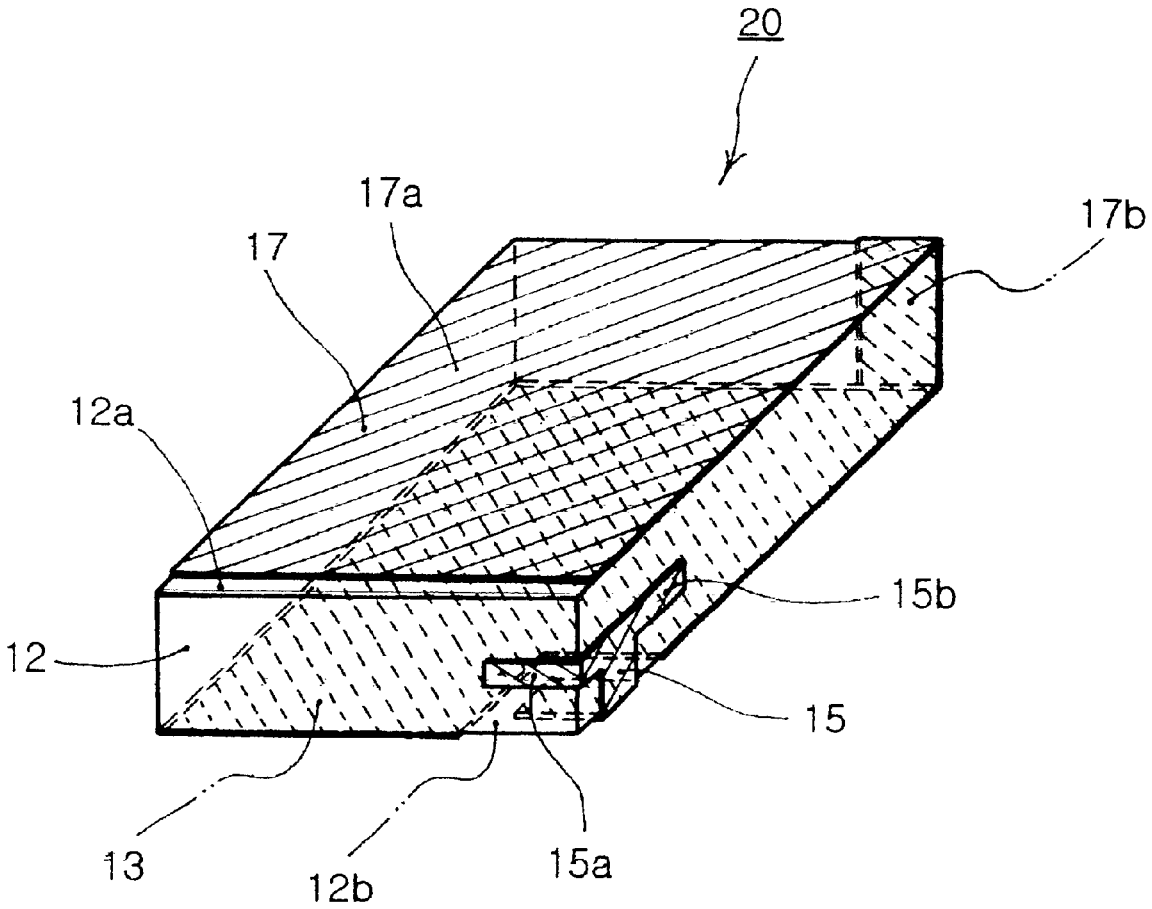
FIG. 2*a* is a perspective view showing a surface mounted chip antenna according to a preferred embodiment of the present invention.

FIG. 2*a* is a perspective view showing a surface mounted chip antenna 20 according to a preferred embodiment of the present invention.

Referring to FIG. 2*a,* the surface mounted chip antenna 20 has a dielectric block 12 made of a ceramic body or a resin. The dielectric block 12 is constructed in the form of a rectangular solid having first and second opposite major surfaces 12*b* and 12*a* on which a ground electrode 13 and a radiation electrode 17 are respectively formed.

Further, a feeding pattern 15 is formed on a side surface between the first and second major surfaces 12*b* and 12*a,* and is spaced apart from the ground electrode 13 and the radiation electrode 17. Further, protrusions 15*a* and 15*b* are additionally formed on both side portions of the feeding pattern 15, such that an electrode having a T shape is formed.

As described above, the chip antenna of the present invention is characterized in that the capacitance between the feeding pattern 15 and the ground electrode 13, and the capacitance between the feeding pattern 15 and the radiation electrode 17 can be adjusted by forming the additional protrusions 15*a* and 15*b* extended from both sides of the feeding pattern 15. In more detail, the capacitance generated between the feeding pattern 15 and the ground electrode 13 and between the feeding pattern 15 and the radiation electrode 17 can be adjusted by adjusting the distances of the protrusions 15*a* and 15*b* extended from the feeding pattern 15. Subsequently, impedance matching in the surface mounted chip antenna 10 is easily performed.

Especially, the chip antenna 10 according to the preferred embodiment is advantageous in that one protrusion 15*a* of the two protrusions 15*a* and 15*b* is extended to a side surface adjacent to the side surface on which the feeding pattern 15 is formed, such that a range of capacitance adjustments by the protrusions 15*a* and 15*b* is wide.

Further, the feeding pattern 15 can be extended to a corner of the first major surface 12*b* on which the ground electrode 13 is formed. Then, when the dielectric block 12 is mounted on another substrate, the feeding pattern 15*a* can be connected to a feeding line on the substrate. In such a case, because the ground electrode 13 must be spaced apart from the feeding pattern 15, the ground electrode 13 can be changed in its shape according to the shape of the feeding pattern 15.

Further, the radiation electrode 17 has a radiation portion 17*a* formed on the second major surface 12*a* of the dielectric block 12, and a short portion 17*b* formed on at least one side surface of the dielectric block 12 and used for coupling the radiation portion 17*a* and the ground electrode 13.

Figure 2B:
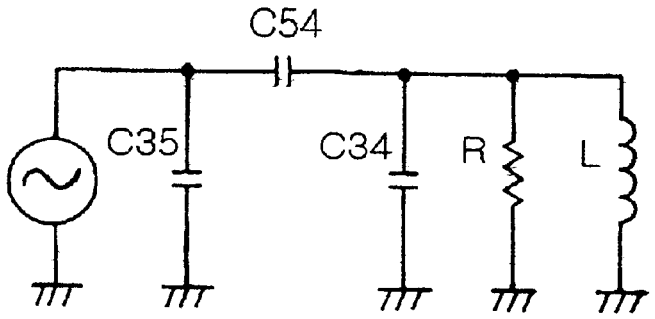

Hereinafter, the process of impedance matching using the protrusions 15*a* and 15*b* of the feeding pattern 15 is described in detail, with reference to FIG. 2*b*. FIG. 2*b* is a schematic circuit diagram of an equivalent circuit of the surface mounted chip antenna shown in FIG. 2*a*.

Referring to FIG. 2*b,* the circuit diagram shows a resonance circuit comprised of an inductor L, a resistor R and capacitors C34, C35 and C54. The inductor L is a self inductance of the radiation electrode 17, and the resistor R is a resistance by the radiation electrode 17. Such resistance is the same as resonance energy radiated into space.

Further, the capacitor C34 is the capacitance between the radiation electrode 17 and the ground electrode 13, and the capacitor C54 is the capacitance between the feeding pattern 15 and the radiation electrode 17. Further, the capacitor C35 is the capacitance between the feeding pattern 15 and the ground electrode 13.

When a signal is applied to the resonance circuit from a high frequency (RF) signal source through the capacitor C54, the resonance circuit resonates and acts as a transmission antenna while radiating part of the resonance energy into space. Here, it is significant to realize impedance matching between the resonance circuit and an external circuit generating the high frequency signal source. In the preferred embodiment, the impedance matching can be easily realized by adjusting the lengths of both protrusions 15*a* and 15*b* of the feeding pattern 15 having a T shape, thereby varying the capacitance C35 between the feeding pattern 15 and the ground electrode 13, as described above.

Meanwhile, the dielectric block of the above embodiment of this invention can be combined with that of another preferred embodiment in miniaturizing the chip antenna. In other words, the chip antenna of this invention can be embodied to form at least one conduction pattern extended from the radiation electrode or the ground electrode on one side surface of the dielectric block, thus increasing the capacitive coupling between the radiation electrode and the ground electrode.

Figure 3:
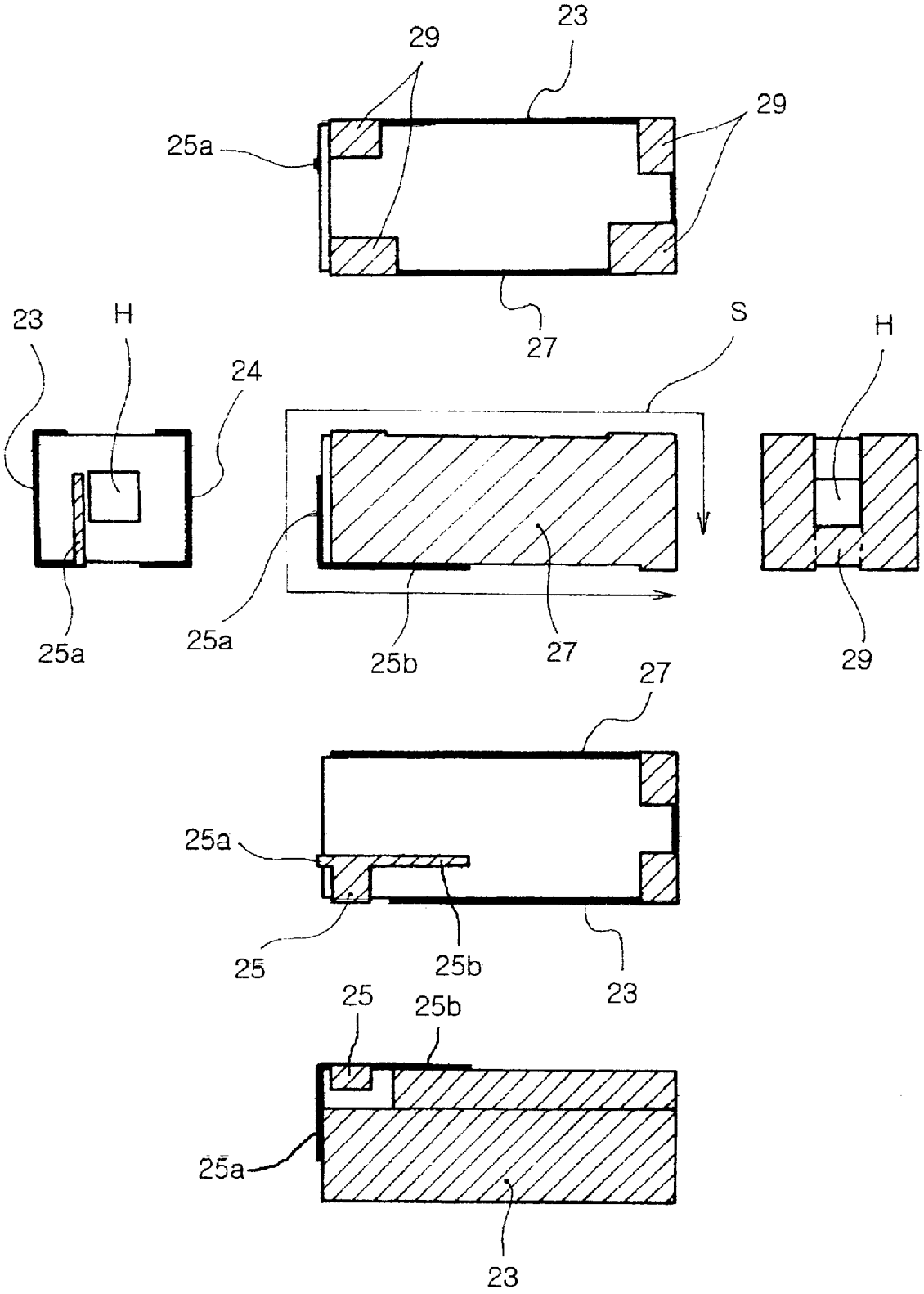
* and FIG. 3 is a development view showing another surface mounted chip antenna according to another preferred embodiment of this invention.

FIG. 3 shows another surface mounted chip antenna in which at least one conductor pattern is formed on one side surface of the dielectric block according to another preferred embodiment of this invention. Referring to FIG. 3, developed surfaces of the surface mounted chip antenna are shown. The chip antenna includes a feeding pattern 25 having the same T shape as that of FIG. 2*a*.

Additionally, the chip antenna according to the preferred embodiment of FIG. 3 has at least one conduction pattern 29 extended from a radiation electrode 27 or a ground electrode 23 and formed on at least one side surface of a dielectric block. The parts of conduction pattern 29 are spaced apart from each other. Accordingly, capacitive coupling between the radiation electrode 27 and the ground electrode 23 can be increased, such that it can be possible to realize a lower resonance frequency, or to reduce the antenna size in case of a same resonance frequency.

Preferably, the conduction pattern 29 is preferably formed on a side surface opposite to the side surface on which the feeding pattern 25 is formed, and can be formed on a side surface adjacent to the side surface on which the feeding pattern 25 is formed.

Figure 1:
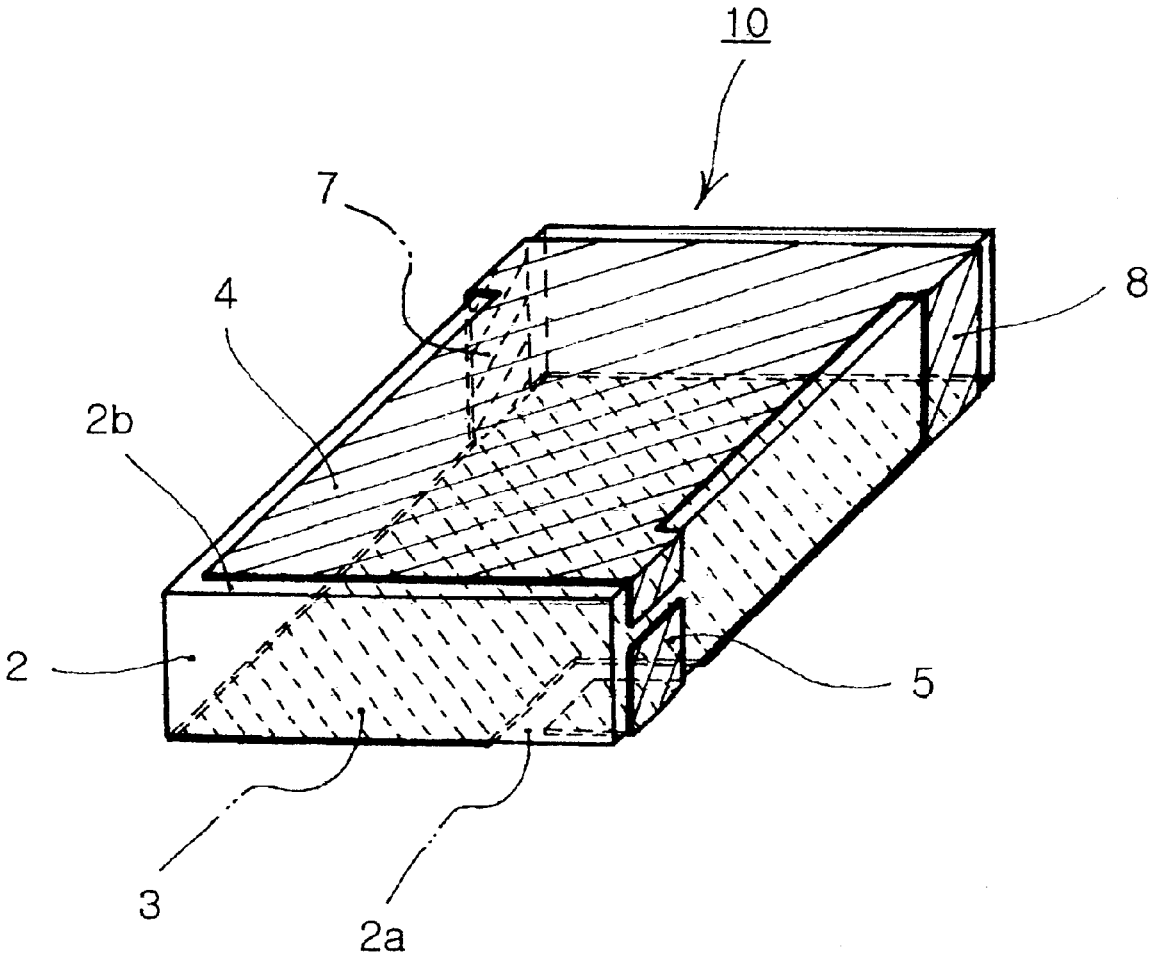
Prior Art FIG. 1
FIG. 1 is a perspective view showing a conventional surface mounted chip antenna.

Therefore, because the chip antenna of FIG. 3 can be further miniaturized, a ceramic body which is a material having a low dielectric constant and allied to alumina can be used as the material for the dielectric block having the same size as that of the chip antenna of FIG. 1. Such a ceramic body allied to alumina has a low specific gravity and a wide usable frequency bandwidth, compared with conventional dielectric materials. Thereby, the ceramic body is advantageous in that it is greatly suitable as a material of a chip antenna for mobile communication terminals.

Especially, in the preferred embodiment of FIG. 3, a through hole H is formed to pass through the center portions of opposite side surfaces of the dielectric block. The chip antenna can be made lighter by the weight of dielectric eliminated due to the through hole H. Such a weight decreasing method can satisfy a requirement for lightening a part of the mobile communication terminal without affecting the performance of the chip antenna. Further, it can be expected to reduce the manufacturing costs of the chip antenna due to little use of expensive dielectric material. The through hole can be formed to have a rectangular section for simplicity in a manufacturing sense, which is also preferable for structural stability. However, the shape of the through hole is not limited to such a form.

As described above, the present invention provides a surface mounted chip antenna, for easily performing an impedance matching by forming a protrusion on at least one side portion of a feeding pattern formed on a side surface of a dielectric block, and adjusting a capacitance between the feeding pattern and a ground electrode or between the feeding pattern and a radiation electrode, according to the length of the protrusion. Further, the surface mounted chip antenna of the present invention is advantageous in that at least one conduction pattern extended from the radiation electrode or the ground electrode is formed on a side surface of the dielectric block, such that capacitive coupling between the radiation electrode and the ground electrode is increased, thus lowering the resonance frequency or reducing an antenna size.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A surface mounted chip antenna comprising:

a dielectric block constructed in the form of a rectangular solid having first and second opposite major surfaces;

a ground electrode formed on the first major surface of the dielectric block;

a radiation electrode for resonating at a predetermined resonance frequency, the radiation electrode comprising a radiation portion formed on the second major surface of the dielectric block and a short portion formed on at least one side surface of the dielectric block and used for coupling the radiation portion and the ground electrode; and a feeding pattern formed on at least one side surface of the dielectric block and spaced apart from the radiation electrode and the ground electrode, the feeding pattern having at least one protrusion on a portion adjacent to the radiation electrode.

2. The chip antenna according to claim 1, wherein the feeding pattern has a T shape formed by longitudinally extending the protrusion on the side surface of the dielectric block.

3. The chip antenna according to claim 1, wherein the feeding pattern is formed to be extended from the side surface of the dielectric block to a portion of the first major surface.

4. The chip antenna according to claim 1, wherein the protrusion of the feeding pattern is extended to a side surface adjacent to the side surface on which the feeding pattern is formed.

5. The chip antenna according to claim 1, further comprising a through hole formed to pass through the portions of the opposite side surfaces of the dielectric block.

6. The chip antenna according to claim 5, wherein the through hole has a rectangular pillar shape.

7. The chip antenna according to claim 1, wherein the short portion connected to the ground electrode is formed on a side surface not adjacent to the side surface on which the feeding pattern is formed.

8. The chip antenna according to claim 1, further comprising at least one conduction pattern formed on at least one side surface of the dielectric block and extended from the radiation electrode to a portion of the side surface of the dielectric block.

9. The chip antenna according to claim 1, further comprising at least one conduction pattern formed on at least one side surface of the dielectric block and extended from the ground electrode to a portion of the side surface of the dielectric block.

* * * * *